US007243774B2

(12) United States Patent
String

(10) Patent No.: US 7,243,774 B2
(45) Date of Patent: Jul. 17, 2007

(54) HIGH SPEED COIN PROCESSING MACHINE

(76) Inventor: Gregory F. String, 411 Huron Dr., Mechanicsburg, PA (US) 17050

( * ) Notice: Subject to any disclaimer, the term of this patent is extended or adjusted under 35 U.S.C. 154(b) by 0 days.

(21) Appl. No.: 11/249,067

(22) Filed: Oct. 12, 2005

(65) Prior Publication Data

US 2006/0151285 A1 Jul. 13, 2006

Related U.S. Application Data

(63) Continuation-in-part of application No. 11/032,718, filed on Jan. 11, 2005.

(51) Int. Cl.
*G07F 9/10* (2006.01)
*G07F 1/04* (2006.01)

(52) U.S. Cl. ..... 194/350; 141/314

(58) Field of Classification Search ..... 194/350, 194/344; 193/DIG. 1; 141/10, 311 R, 312, 141/313, 314, 315
See application file for complete search history.

(56) References Cited

U.S. PATENT DOCUMENTS 6,004,200 A * 12/1999 Ebenhoch et al. ..... 453/63
6,131,625 A * 10/2000 Casanova et al. ..... 141/314

* cited by examiner

*Primary Examiner*—Patrick Mackey
*Assistant Examiner*—Mark J. Beauchaine
(74) *Attorney, Agent, or Firm*—Hooker & Habib, P.C.

(57) ABSTRACT

A coin processing machine for sorting or verifying coins discharges coins through one or more coin tubes and includes a disk mounted on a drive shaft by a nut threaded on the shaft. Each coin tube includes a coin bag support with a non-flexible bracket that presses the bag against the support. A high-friction washer is located between the nut and disk to resist loosening of the nut during machine operation.

10 Claims, 10 Drawing Sheets

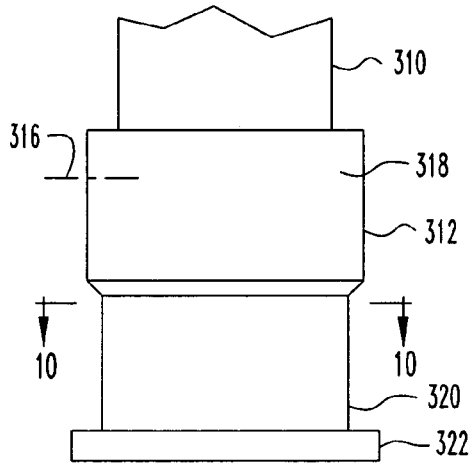
FIG. 7
FIG. 8
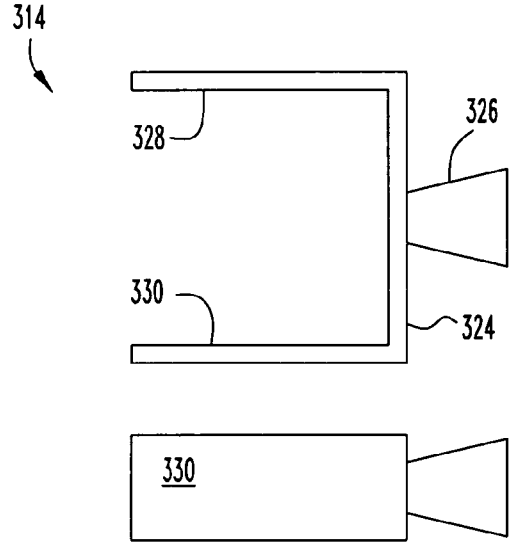
FIG. 9
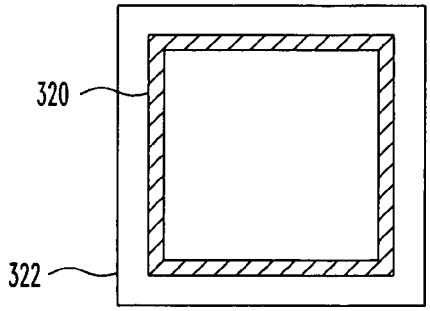
FIG. 10

FIG. 13
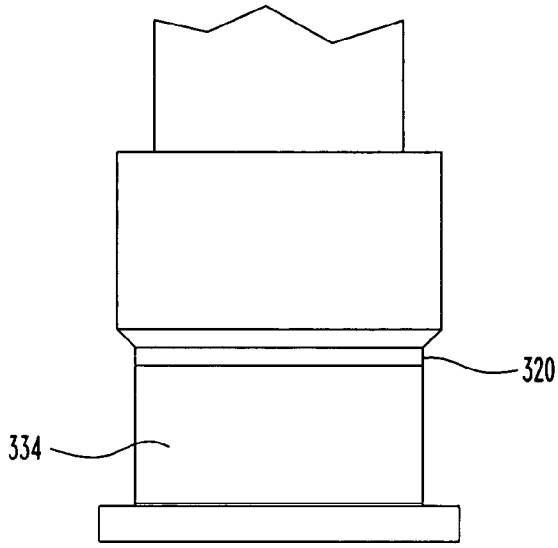
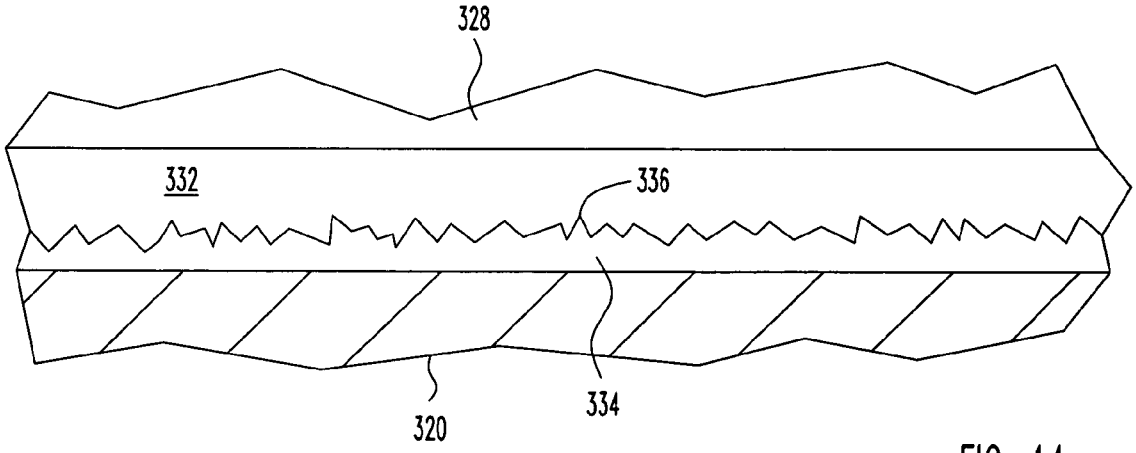
FIG. 14

FIG. 15
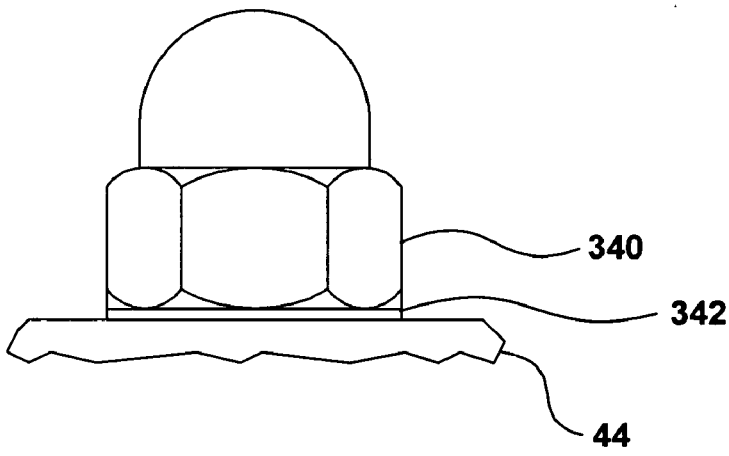
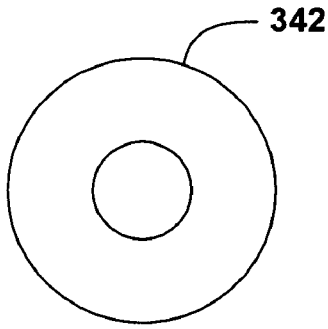
FIG. 16

HIGH SPEED COIN PROCESSING MACHINE

This application is a continuation-in-part of currently pending application Ser. No. 11/032,718 filed Jan. 11, 2005.

FIELD OF THE INVENTION

The invention relates generally to devices for processing mixed denominations of coins, that is, devices for sorting or verifying coins.

BACKGROUND OF THE INVENTION

Banks and other business handle mixed denominations of coins. The coins must be sorted by denomination, and the sorted coins are wrapped or bundled for deposit or later use in cash registers or change machines.

Coin processing machines, such as coin sorters and coin verifiers, have been developed to mechanically process mixed denominations of coins. Coin sorters sort the coins. Coin verifiers verify that sorted coins are made up of only coins of a single denomination. Coin verifiers are often used prior to wrapping or bundling coins discharged from a coin sorter.

Coin processing machines include a hopper that receives the coins and a processing device that sorts or verifies coins. The hopper discharges a stream of coins to the processing device where the coins move on a plate defining a coin path. In one known coin sorter, the coin path has openings for respective diameter of coins. In one known coin verifier, the coin path has a single opening that enables only coins of the desired denomination to pass through the opening. Coins having a larger diameter, however, jam the machine and must be manually removed.

A known coin sorter disclosed in Adams et al. U.S. Pat. No. 5,525,104 (which patent is incorporated herein by reference) includes a hopper having a turntable or rotatable disk that receives the coins and throws the coins against a wall extending along the disk. The coins are discharged in single file and move along a circular coin path in the processing device. The circular hopper disk and circular coin path both reduce the space taken up by the coin sorter. The coins are driven along the coin path by a rotating drive disk. The drive disk overlaps the hopper disk to transfer the coins from the hopper to the processing device.

Although the known coin sorter operates well when new, overlapping of the rotating hopper and drive disks causes rapid wear of the hopper disk. The hopper disk must be replaced frequently, increasing cost and downtime. If replacement is delayed, coins discharged from the worn hopper disk are misaligned on the coin path and may be mis-sorted. The mis-sorted coins may later jam a coin verifier, causing additional downtime and expense.

Coin processing machines also typically discharge coins into discharge tubes. Coin bags are attached to bag supports on the end of the tubes and receive the coins. When a bag is filled, the machine stops and the coin bag is replaced.

One conventional bag support disclosed in Adams et al. U.S. Pat. No. 5,443,419 requires users to thread the coin bag through a ring mounted on a flared spout. Users find this awkward and time-consuming, greatly increasing the downtime of the machine in a high-production environment. Another conventional bag support disclosed in Rassmussen, U.S. Pat. No. 5,297,598 uses a spring clamp to hold the bag onto the discharge tube. The spring clamp is easily damaged, also increasing downtime.

High-speed coin processing machines have disks mounted on motor drive shafts by nuts threaded on the shafts. The nuts press against the disks. Sudden machine stops can loosen the nuts; it is speculated that the coefficient of static friction between metal nut and metal disk is too low to generate sufficient frictional force to prevent the nut from unthreading. Some machines extend a resilient cord from the nut to the disk to resist loosening of the nut. The cords are prone to failure, further increasing downtime.

Thus there is a need for an improved coin processing machine suitable for a high-production environment that reduces downtime. The coin processing machine should reduce wear of the hopper disk, include bag supports that facilitate changing coin bags, and resist loosening of nuts caused by sudden stops from high speed. The coin processing machine should reliably sort or verify coins without misalignment of coins or jamming, and preferably should enable even higher processing speeds than conventional processing machines.

SUMMARY OF THE INVENTION

The invention is directed to an improved coin processing machine that reduces wear of the hopper disk. The coin processing machine of the present invention reliably sorts or verify coins without misalignment or jamming, and enables even higher processing speeds than conventional processing machines.

A coin processing machine in accordance with the present invention includes a hopper for receiving and discharging coins, a processing device to one side of the hopper, and a feed device extending between the hopper and the processing device to drive coins discharged from the hopper to the processing device. The feed device includes a transfer plate configured to support coins discharged from the hopper and a drive for driving coins along the transfer plate. The drive has an endless belt configured to engage and urge coins along the transfer plate. The processing device comprising a processing plate configured to support coins discharged from the transfer plate, the processing plate defining a curved processing track, and a disk rotatable with respect to the processing plate and facing the processing plate to drive coins along the processing track;

The disk overlaps a portion of the transfer plate to engage coins on the transfer plate and move the coins from the transfer plate to and along the processing track.

The processing machine of the present invention has a number of advantages. The disk does not overlap the hopper and wear caused by the overlap is eliminated. The belt preferably accelerates the coins received from the hopper, spacing the coins apart when received by the disk. The disk can further accelerate the coins transferred to the processing plate to further space the coins apart. This further increases processing speed and reliability.

In preferred embodiments of the present invention, the rotational axis of the disk is offset from the center of the processing track. A wall surrounds the periphery of the processing track. As the coins are driven along the track, the wall moves the coins towards the center of the disk, ensuring the coins are reliably positioned against the wall, further increasing operating reliability of the machine.

In one embodiment the processing device is a coin verifier that greatly reduces or eliminates jamming experienced using conventional coin verifiers. The verifier has three openings in the processing path. The first opening is upstream from the other two openings and removes coins whose diameter is smaller than the coin being verified. The second, next downstream opening, removes coins being verified. The third opening remains all remaining coins or material. Oversized coins or slugs do not jam the machine, enabling large amounts of coins to be quickly and reliably processed without downtime.

In preferred embodiments of the coin verifier sensors are placed between the first and second openings and between the second and third openings. Coins passing the first sensor increment a running coin count and coins passing the second sensor decrement the running count to maintain an accurate count of verified coins processed by the machine.

In another embodiment the processing machine is a coin sorter for sorting coins of mixed denominations. The sorter has a number of openings in the processing path. A sensor array upstream of the openings discriminates the diameter of the coins being sorted and provides a running count of each coin denomination. The sensor has no moving parts and does not require a complex imaging system.

In yet other embodiments the processing machine includes multiple coin bag clamping devices that enable filled coin bags to be quickly removed and replaced with empty bags. Each device includes a tubular extension mounted to the end of a coin discharge and includes a rigid clip that clamps the bag against the extension. Preferably the outer surface of the extension has an enhanced friction surface that resists slipping of the bag held between the extension and the clip.

In further embodiments of the invention high friction material is placed between a nut retaining the disk on a motor drive shaft and the disk. The material resists loosening of the nut upon sudden deceleration of the disk.

Other objects and features of the present invention will become apparent as the description proceeds, especially when taken in conjunction with the accompanying drawing sheet illustrating three embodiments of the invention.

BRIEF DESCRIPTION OF THE DRAWINGS

FIG. 7 is a partial sectional front view of the coin discharge tube and coin bag support member used in the coin processing devices shown in FIGS. 1 and 6;

FIGS. 8 and 9 are top and front views of the coin bag restraint device used with the coin bag support member shown in FIG. 7;

FIG. 10 is a sectional view of the coin bag support member taken along lines 10-10 of FIG. 7;

FIG. 13 is a view of the rotating disk of the coin processing machine shown in FIGS. 1 and 6 on the end of a drive shaft;

FIG. 14 is a front view of the washer shown in FIG. 13;

FIG. 15 is a side view of the dome nut that retains the disk on the end of the drive shaft; and FIG. 16 is a top view of the dome nut.

DESCRIPTION OF THE PREFERRED EMBODIMENT

Figure 1:
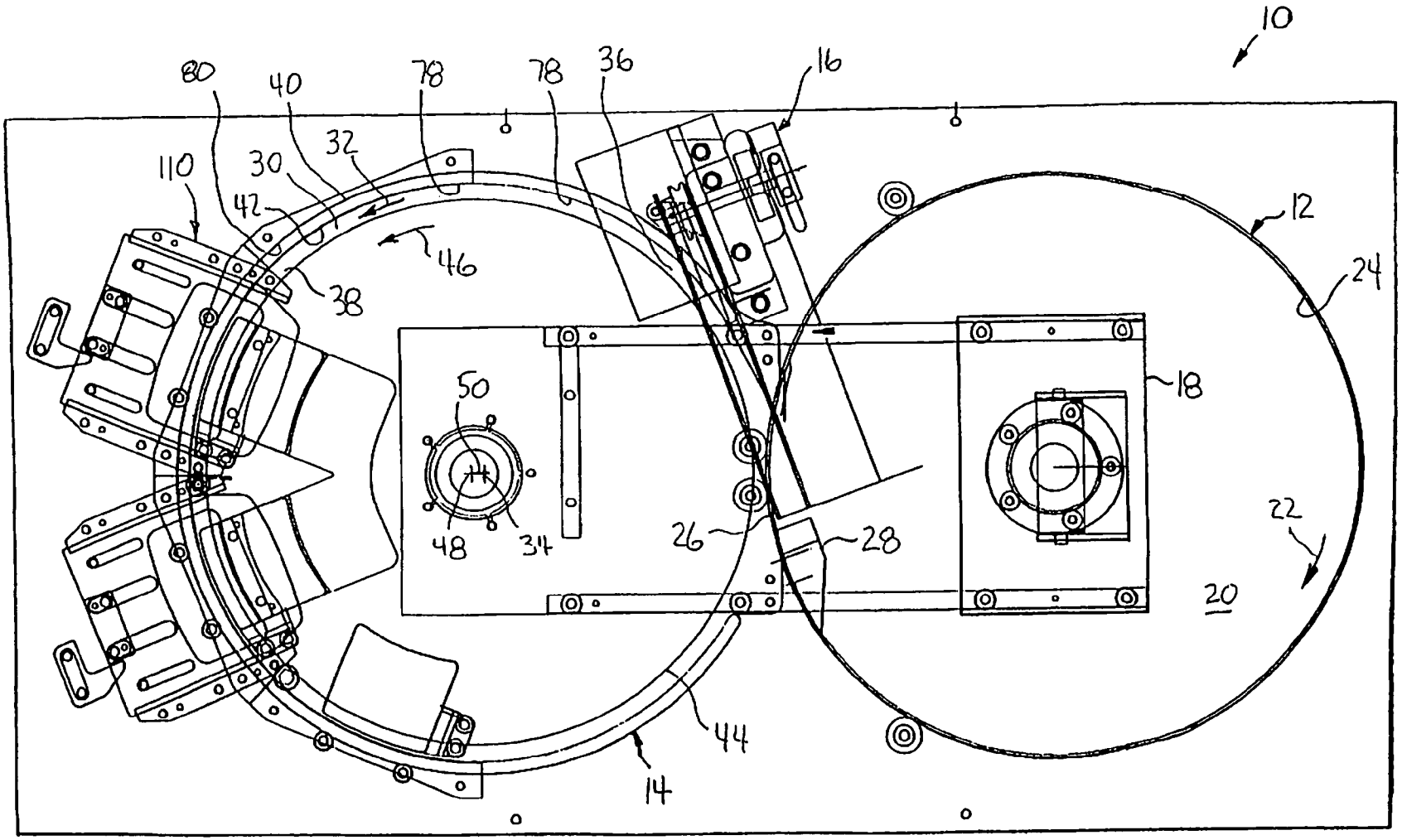
FIG. 1 is a top view of a first embodiment coin processing machine in accordance with the present invention.
Figure 2:
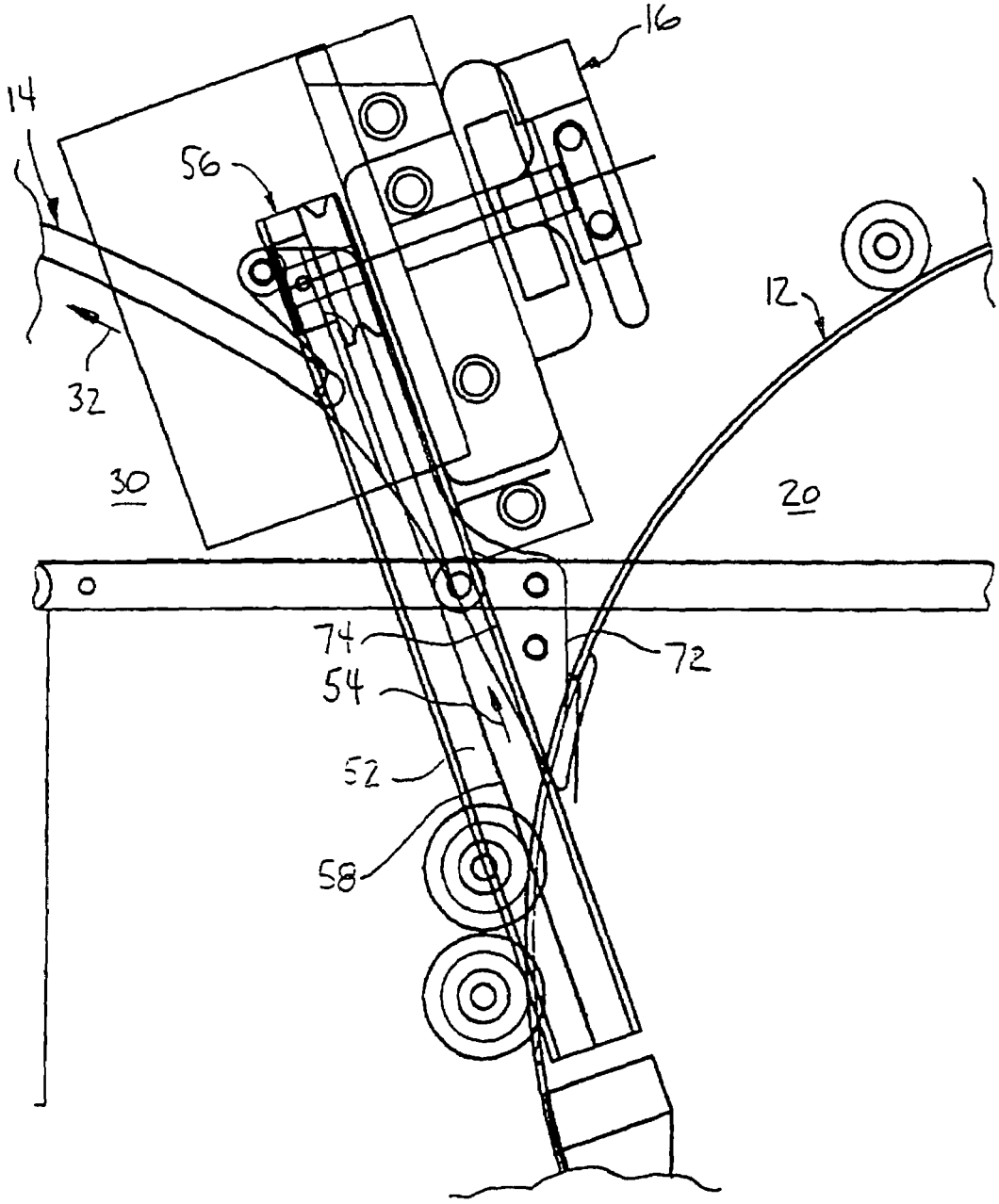
FIG. 2 is an enlarged view of a portion of FIG. 1 illustrating the feed device used in the coin machine.

FIG. 1 illustrates a high-speed coin processing machine 10 in accordance with the present invention. The machine 10 includes a hopper 12 for receiving coins to be processed. The hopper 12 discharges a stream of coins for processing by a processing device 14. The illustrated processing device 14 verifies coins. A feed device 16 receives the coins discharged from the hopper 12 and transfers the coins to the processing device 14.

The hopper 12 has an inlet 18 that deposits coins on a turntable or rotatable disk 20 forming the floor of the hopper 12. The disk 20 is driven in the direction of arrow 22 by an electric motor (not shown). A stationary outer wall 24 extends along the outer periphery of the disk 20 to a discharge end 26 where coins are discharged from the hopper. Coins on the disk 20 are urged by centrifugal force against the wall 24 and move along the wall in the direction of disk rotation to the discharge end of the wall. A singulating plate 28 mounted on the wall 24 extends over the disk 20 at the hopper discharge. Plate 28 is spaced above the disk 20 by a distance less than twice the thickness of the thinnest coin to be processed (a dime if processing US currency). A single-layer stream of coins is discharged from the hopper 12 from beneath plate 28 in a direction substantially tangential to the disk 20.

Processing device 14 is located to one side of the hopper 12 and includes a stationary processing plate 30 that receives the stream of coins from the hopper 12. The upper, coin-supporting surfaces of the hopper disk 20 and the processing plate 30 are substantially co-planar. The processing plate 30 includes a circular coin path or processing path 32 that extends around a center of curvature 34. The coin path 32 extends downstream from an intake end 36 to a processing station 38 where the coins are processed. A wall 40 extends along the coin path 32 and has a circular inner abutment surface 42 that guides coins along the coin path. The wall 40 begins downstream of the intake end 36 and extends through the processing station 38.

A rotatable disk 44 is mounted above the processing plate 30. The outer periphery of the disk 44 is driven in the direction of arrow 46 by an electric motor (not shown) to drive the coins along the coin path 32. The disk 44 rotates about an axis of rotation 48 that is spaced from the center of curvature 34 away from the hopper 12 by an offset distance 50. There is clearance between the outer periphery of the disk 44 and the wall 40.

The underside of the disk 44 facing the plate 30 is spaced above the plate 30 with sufficient clearance to permit the thickest coin to be received under the disk. Spaced apart, flexible fingers (not shown) extend from the underside of the disk 44 above the coin path 32 to engage and drive the coins.

Feed device 16 includes a transfer plate 52 that extends between the hopper 12 and the processing device 14. The upper, coin-supporting surface of the transfer plate 52 is co-planar with the coin-supporting surfaces of the hopper disk 20 and the processing plate 30 and includes a coin path 54 that is substantially tangential to both the hopper disk 20 and the coin path 32. A feed drive 56 drives the coins discharged from the hopper 12 along the transfer plate and to the processing device 14.

In the illustrated embodiment the processing plate 30 and the transfer plate 54 are formed as a one-piece member. In other possible embodiments the plates 30, 54 can be individual, separate members.

Figure 3:
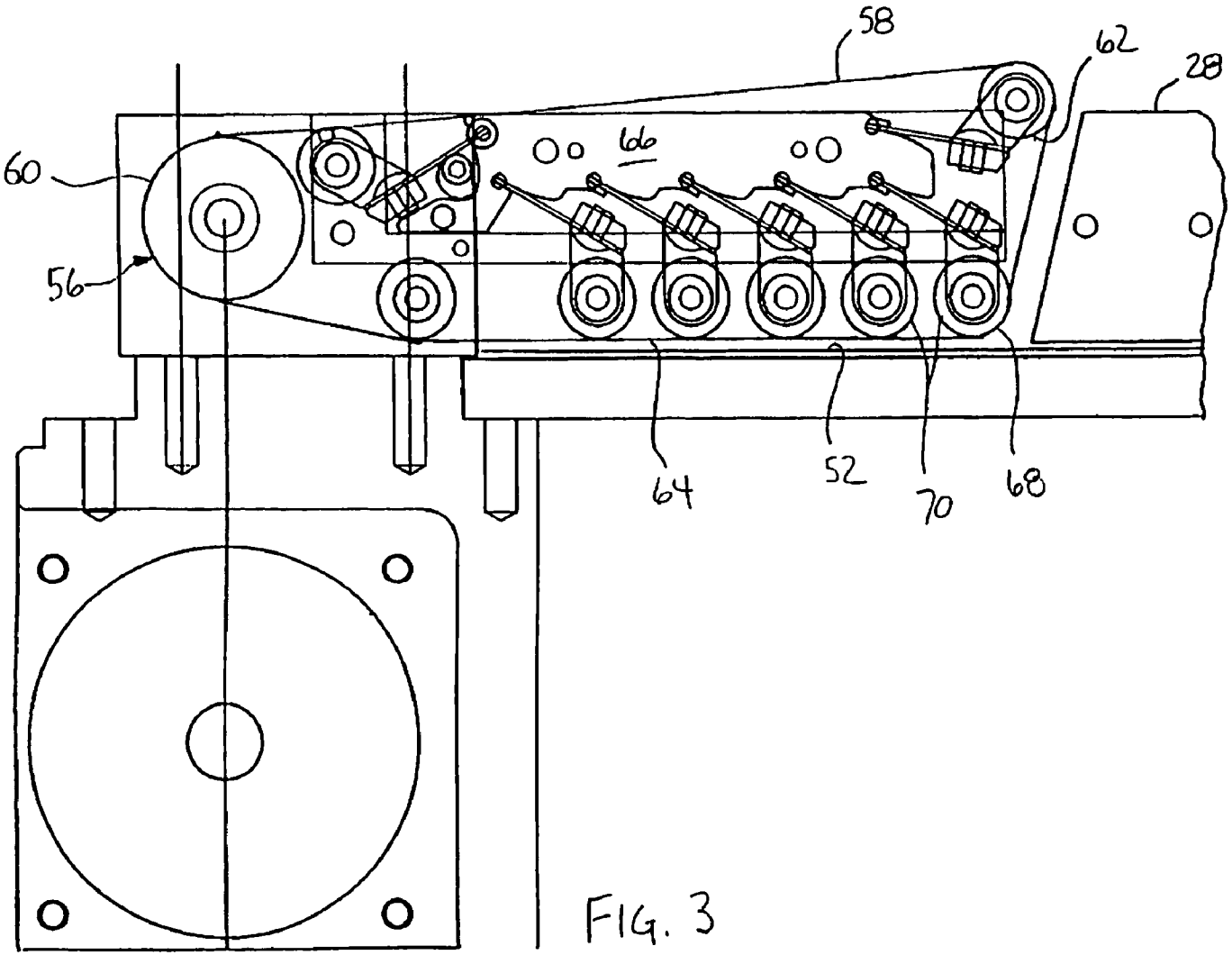
FIG. 3 is a side view of the feed device shown in FIG. 2.
Figure 4:
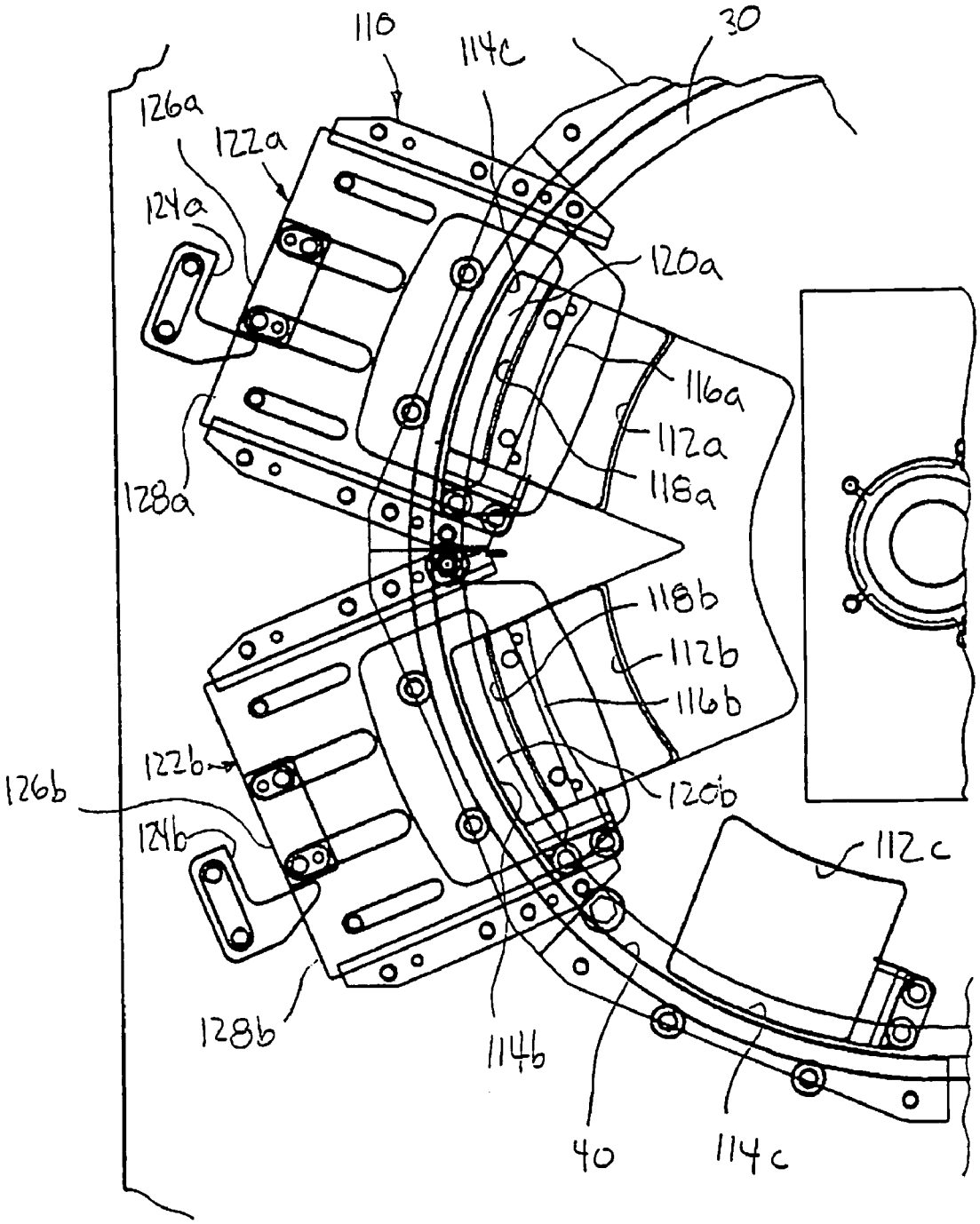
FIG. 4 is an enlarged view of the processing device used in the coin machine shown in FIG. 1.
Figure 5:
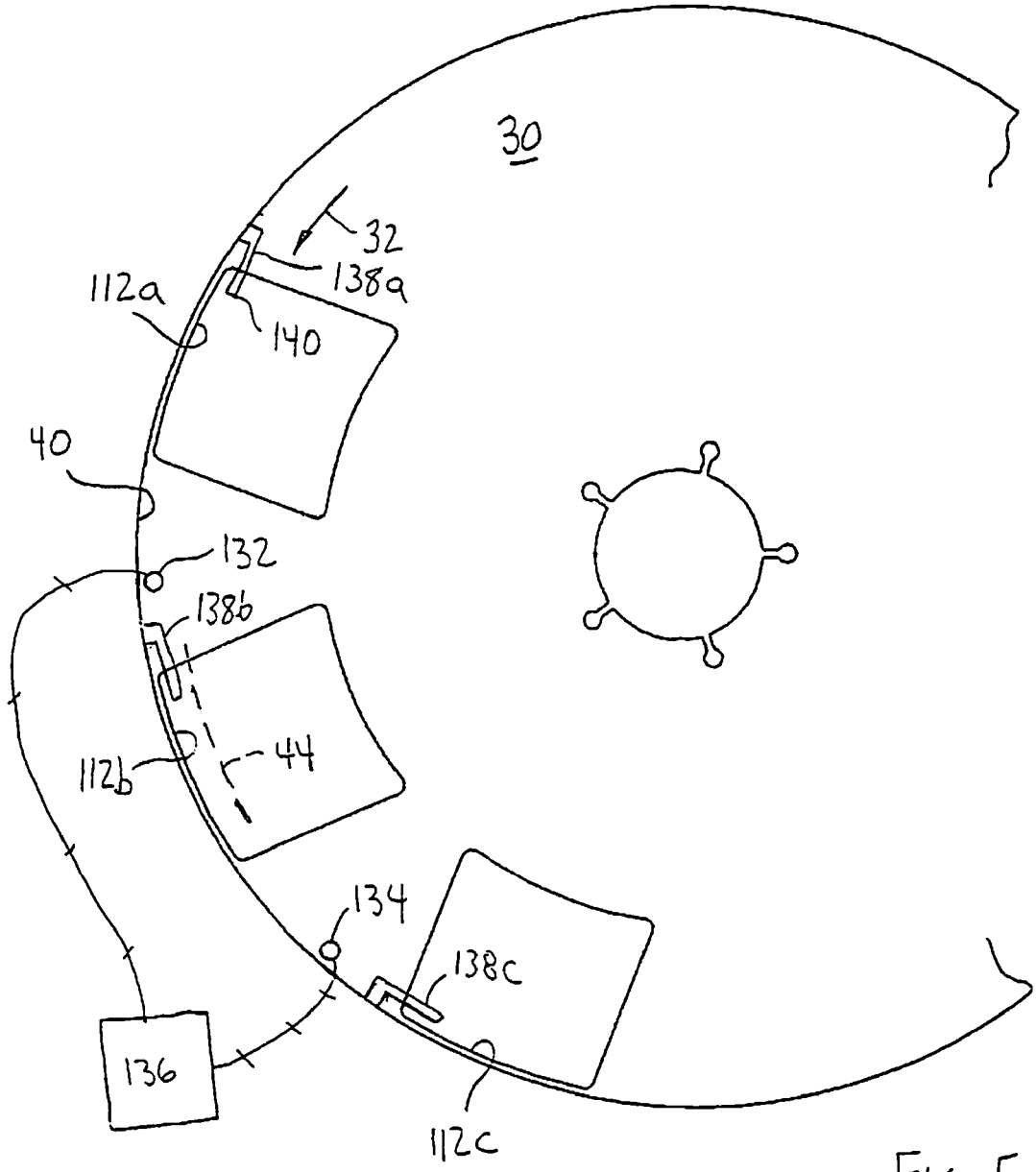
FIG. 5 is a top view of the processor plate used in the processing device shown in FIG. 4.

Feed drive 56 includes an endless flexible belt 58 that extends around a drive pulley 60 and a driven pulley 62 as best seen in FIG. 3. The belt 58 has a lower belt run 64 that is spaced above and extends along the coin path 52 and driven in the direction of coin path arrow 52. The driven pulley 62 is spring-mounted on an elongate cantilever arm 66 that enables the belt run 64 to have an intake end 68 located above the hopper disk 20 and closely spaced from the singulating plate 28. Intermediate spring-mounted idler pulleys 70 attached to the arm 66 urge the lower belt run 64 against even thin coins spaced between thicker coins to reliably drive the coins along the transfer plate 52.

The belt run 64 is substantially centered over the coins discharged from the hopper 12. The width of the belt 58 is substantially less than the diameter of the smallest-diameter coin.

The disk 44 overlaps the transfer plate 58 to transfer coins from the feed device 16 to the processing device 14. The disk 44 is closely spaced from the lower belt run 64 to allow the disk 44 to overlap and engage the exposed portions of the coins not covered by the belt 58.

To assure proper alignment of the coins along the transfer path 54, feed drive 56 includes an alignment plate 72 mounted on the transfer plate 52 on the side of the belt 58 away from the processing device 14. The alignment plate 72 is spaced slightly above the transfer plate 58 and extends over the hopper disk 20 as shown. The plate 72 includes an elongate alignment surface 74 that extends along one side of the transfer path 54. The surface 74 abuts the stream of coins driven by the belt run 64 and preferably extends downstream slightly towards the belt run 64. The surface 74 assures proper alignment of the coins under the belt run 64 for takeaway by the disk 44 and assists in transferring the coins to the disk 44.

Operation of the feed device 16 in transferring coins from the hopper 12 to the processing device 14 is as follows. The hopper disk 20 is rotating at speed and discharges a stream of coins from beneath the singulating plate 28. The coins are touching each other and moving at essentially the speed $v_d$ of the outer periphery of the disk 20.

The coins enter the belt intake end 68 and engage the lower belt run 64. Belt 58 is driven at a speed $v_b$ greater than $V_d$ so that the coins are accelerated as they engage and are driven by the belt. The acceleration spaces the coins apart as the belt receives and drives them along the coin path 54.

The flow of coins from the hopper 12 to the processing device 14 can be stopped, however, by stopping the belt 58 without the need of stopping hopper turntable 2*o*.

The belt run 64 is optimally positioned to engage coins that are against the hopper wall 24 as they are discharged from the hopper 12. Coins not against the wall 24 when discharged will engage the alignment plate 72 and are urged by the alignment surface 74 towards the belt run 44.

Coins moving along the transfer plate 52 enter the area of the transfer plate overlapped by the processor disk 44. The disk 44 engages the exposed portions of the coins not covered by the belt 58 and drives the coins away from the belt run 64 towards the intake end 36 of coin path 32. The processor disk 44 rotates at a speed that drives the coins at a speed $v_p$ preferably greater than $v_b$ to smoothly transfer the spaced apart coins from the transfer plate 52 to the processing coin path 32. By further increasing the speed of the coins, the disk 44 further increases the spacing between coins entering the processor coin path 32.

The coins reach wall 40 and abut the inner wall surface 42 as the disk 44 drives the coins along the coin path 32. The distance from the wall surface 42 to the rotational axis 48 of the disk 44 decreases as the coins move along the wall towards the processing station 38. The decreasing distance occurs on account of the offset 50 of the disk axis 48 from the wall's center of curvature 34.

As the coins move along the wall 40 from wall surface portion 78 to downstream wall surface portion 80, the distance of the coins from rotational axis 48 decreases as described above. The coins are pressed firmly against the wall 40 as the wall 40 pushes and moves the coins inwardly with respect to the disk 44. This enables an optional coin sensing device located at a sensing station upstream of the processing station 38 to rely on the coins being reliably located against the wall 40 as they pass the sensing station.

The processing station 38 of the illustrated processing delivers coins to a coin verifier 110 intended to verify coins having a predetermined diameter (the "verified coin diameter"). The processor coin path 32 extends through the coin verifier 110 and the wall 40 also extends through the coin verifier to guide coins through the verifier.

Coin verifier 110 includes three circumferentially-spaced openings 112*a*, 112*b*, and 112*c* formed in the processor coin path 32. Each opening 112 extends through the thickness of the processing plate 30 and has a fixed, curved outer edge 114 that is spaced slightly inwardly from the wall 40. Carried in the openings 112*a* and 112*b* are movable members 116*a*, 116*b* that carry respective curved inner edges 118*a*, 118*b* facing an outer edge 114. The edges 114, 118 define respective coin slots 120*a*, 120*b* from the openings 112*a*, 112*b*. The upper surface of each member 116 is substantially co-planar with the upper surface of the processing plate 30.

The width of the slots 120*a*, 120*b* is established by respective calipers 122*a*, 122*b*. Each caliper 122 has a fixed caliper jaw 124 and a second, movable caliper jaw 126. Caliper jaw 126 is attached to and drives a lower plate 128 that extends beneath the processing plate 30 and positions the movable member 116 in the opening 120.

Closing each caliper 122 on a coin of the denomination being verified uses the coin as a template establishing the correct widths of slots 120*a*, 122*b*. Edge 118*a* is spaced away from the wall 40 a distance slightly less than the verified coin diameter, but not less than the diameter of the next smaller coin diameter (if any). Edge 118*b* is spaced away from the wall 40 a distance slightly greater than the verified coin diameter, but not greater than the diameter of the next larger coin diameter (if any). Plates 128 are fixed in position against the plate 30 by tightening setscrews 130 extending through elongate mounting slots in each plate 128.

Sensors 132 and 134 are located in the coin path 32 downstream from the first slot 120*a*. Sensor 132 is between the first slot 120*a* and the second slot 120*b*. Sensor 134 is between the second slot 120*b* and the opening 120*c*. The sensors 132, 134 are spaced from the wall 40 a distance less than the minimum coin diameter and each generates a signal indicating a coin has passed over it. Alternatively, the sensors 132, 134 can be mounted in the wall 40 and detect the edge of the coins in the coin path 32. A controller 136 receives the sensor signals to keep a running count of verified coins.

Three leaf springs 138*a*, 138*b*, and 138*c* are mounted along the wall 40 adjacent respective openings 112*a*, 112*b*, and 112*c*. Each leaf spring 138 extends to a free end 140 between the disk 44 and the wall 40 immediately upstream or over the respective slot opening 112. The free end 140 is normally spaced above the coin path 32 a distance less than the thickness of the thinnest coin.

Operation of the coin verifier 110 is described next. The coins moving along the coin path 32 first approach coin slot 120*a*. Each coin engages the free end of spring 138*a*, upwardly deflecting the spring and generating a spring force pressing the coin against the coin path. When the coin reaches coin slot 120*a*, the outer edge of the coin is supported on the portion of the path between the wall 40 and the slot edge 114*a*. The inner edge of a coin having a diameter at least equal to the verified coin diameter is supported on the slot member 116*a*. The coin is supported on the plate 30 along the entire length of the coin slot 120*a* and moves to the second slot 120*b*.

The outer edge of a coin having a diameter less than the verified coin diameter is not supported on the slot member 116*a*. Slot 120*a* has sufficient length for the coins to fall through the plate 30 and be removed from the stream of coins prior to reaching the slot 120*b*. The spring force generated by the leaf spring 138*a* assists in urging the coin into the slot even if the coin is held between two larger coins or adheres to the disk 44. In this way coins having diameters less than the verified coin diameter are removed from the stream of coins for storage or subsequent processing.

The remaining coins have diameters not less than the verified coin diameter. The coins approach the coin slot 120*b*. Coins having a diameter equal to the verified coin diameter fall through the coin slot 120*b* and are collected. Spring 138*b* assists in urging the coins into the slot. The coins of the denomination being verified are removed from the stream of coins for storage or subsequent processing, such as coin wrapping.

Coins having a diameter greater than the verified coin diameter pass over coin slot 120*b* and then pass over the sensor 134. The sensor generates a signal for each coin passing over the sensor. The controller 136 decrements by one the running count of verified coins in response to each signal received from the sensor 134. This corrects the count for the increment generated by the coin having previously passed the sensor 132. The controller 136 can drive a display indicating the accumulative value of the verified coins processed.

The remaining coins fall through the opening 112*c*, which is substantially larger than the diameter of the largest coin. This assures that no coins travel beyond the opening. Spring 138*c* assists in urging the coins into the opening.

It is contemplated that coins being processed for verification will typically include only a small number of incorrect coins. A large majority of coins will be supported on the coin member 114*a* and will fall through the coin opening 120*a*. As a result, it is likely that member 114*a* will wear much faster than member 114*b*. By making members 114*a*, 114*b* interchangeable, the members 114 can be periodically switched for even wear on both members.

Figure 6:
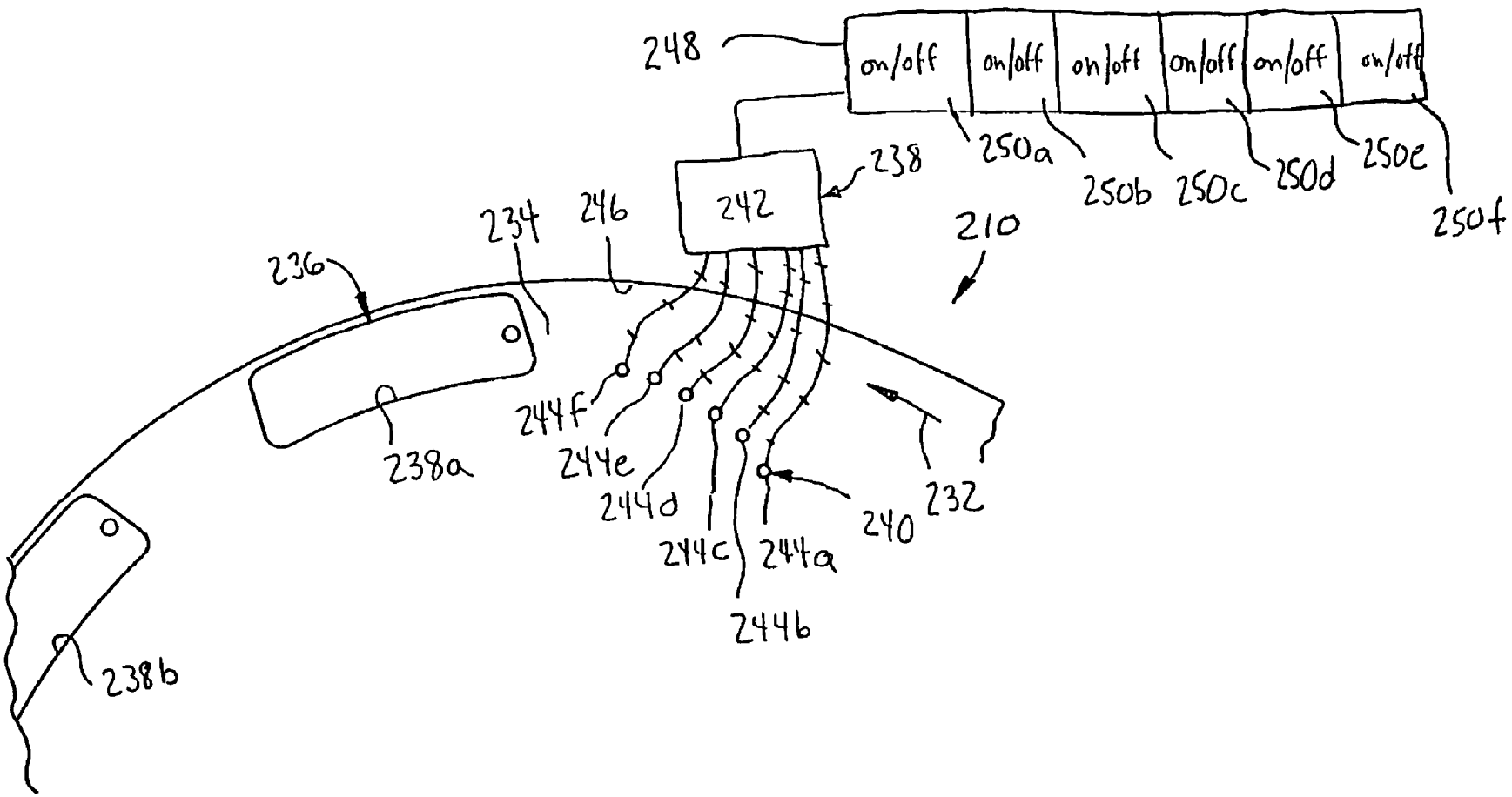
FIG. 6 is a partial top view of a second embodiment coin processing machine in accordance with the present invention.

FIG. 6 illustrates a portion of a second embodiment coin receiving and processing device 210 in accordance with the present invention. Device 210 is similar to the device 10 but sorts coins by denomination rather than verifying them.

The device 210 includes a hopper and feed device (not shown) like the hopper 12 that supplies a stream of coins to a coin path 232 like the coin path 32. The coins are driven along the coin path 232 by a drive disk (also not shown) like the drive disk 44. The processor coin path 232 extends to a processing station 234 where a conventional coin sorter 236 having a number of progressively wider through-slots 238 in the coin pathway 232 receives the coins.

Upstream of the processing station 236 is a coin discrimination device 238 that determines by coin diameter the denominations of coins passing on the coin pathway. The discrimination device 238 includes a sensor array 240 that generates signals and a controller 242 connected to the sensor array to receive and act upon the signals. The controller 242 generates an output signal representing the diameter of the coin for each coin that passes over the sensor array.

The sensor array 240 is made of a number of sensors 244 imbedded in the pathway 232. The sensors 244 are longitudinally spaced apart along the pathway 232 to sense respective locations along the pathway. Each sensor 24 is also spaced transversely away from a wall 246 like the wall 40.

The illustrated sensors 244*a-f* are arranged for discriminating the diameter of US currency and are associated with the half-dollar, the dollar, the quarter, the nickel, the penny, and the dime respectively. Each sensor 244 is associated with a respective coin diameter and a respective sensor location. The sensor location 244*a* associated with the largest coin diameter is upstream of the other sensor locations and each successive downstream sensor location 244*b*, . . . , 244*f* is associated with the next smaller coin diameter.

Each sensor location 244 is spaced from the wall 246 by a distance less than the diameter of the coin associated with the location but greater than the diameter of the next-smaller coin diameter, if any.

As previously described, the outer edges of the coins are reliably positioned against the wall 246 as they pass over the sensors 244. This aligns the inner edges of the coins along a longitudinal axis of the pathway. Each sensor 244 is covered by and can sense only coins having diameters not less than the coin diameter associated with the sensor as the coins move past the sensor array 240 to the processing station.

The inner edge or inner portion of each coin first covers the sensor 244 associated with the denomination of the coin, and successively covers downstream sensors, if any. The sensors 244 covered by the coin sequentially each transmit a respective signal to the controller 242 indicating that the sensor has been covered by the coin.

The controller 242 maintains an internal array 248 representing the sensor state 250*a*-250*f* of each sensor 244*a*-244*f*. The array 248 enables the controller to generate the appropriate output signal in response to a coin covering the sensor corresponding to the coin diameter. Each sensor state is initially "on". The controller 242 generates an output signal only in response to receiving a signal from a sensor 244 whose corresponding sensor state 250 is "on".

As a coin passes over the sensor array 240, the controller 242 receives a signal from the first sensor covered by the coin. The controller checks the state array 248 and determines whether the corresponding sensor state 250 is "on". If so, the controller generates an output signal representative of the denomination of the sensor sending the signal and turns the downstream sensor states to "off".

As the coin passes over each successive downstream sensor 244, sensor, the controller receives a signal from the sensor and determines that the corresponding sensor state is now "off". The controller does not generate an output signal, but turns the corresponding sensor state back to "on".

For an example of operation of the sensor device 238, assume a US quarter passes over the sensor array 240. The quarter causes sensor 244*c* to transmit a first signal to the controller 242 indicating that sensor 244*c* was covered by the coin. The controller 242 generates an output signal representing the quarter, and turns the sensor states 250*d*-250*f* corresponding to sensors 244*d*-244*f* to "off". As the quarter passes over each of the downstream sensors 244*d*, 244*e*, and 244*f*, the controller does not generate an output signal in response to the signals generated by the downstream sensors but turns the corresponding sensor states back to "on" in preparation for sensing the next coin.

Preferably the coins are spaced apart along the pathway 232 a distance greater than the length of the sensor array 240 so that only one coin is passing over the sensor array at a time. If coins are touching the upstream coin might cover a sensor before the downstream coin clears the array. However, the controller 242 can still determine the denominations of the coins even if coins that are touching pass through the sensor array 240 because the upstream coin would always first cover a sensor whose corresponding sensor state is "on".

The sensor array 240 can be mounted on a standardized, removable plate that mounts in a slot in the processing plate for ready adaption of the sensing device 238 to different sets of currency.

The illustrated embodiments 10, 210 illustrate use of the belt drive to transfer coins along a "FIG. 8" path in which the hopper plate and processing disk rotate in opposite directions. The belt drive can be readily adapted for use in coin processing machines in which the hopper plate and the processing disk rotate in the same direction, such as the coin sorter disclosed in Rumbach, U.S. Pat. No. 5,551,911 (which patent is also incorporated by reference herein).

FIGS. 7-10 illustrate a first embodiment coin bag support mounted to a coin discharge tube 310 of machine 10 or machine 210. It is understand that machines 10 or 210 each have a number of discharge tubes that receive and discharge coins from the processing plate. Each tube is provided with a like coin bag support.

The coin bag support includes a bag support member 312 and a separate bag retaining device 314. In the illustrated embodiment support member 312 is removably attached to the discharge end of tube 310 by screws represented by a screw centerline 316. In other embodiments support member 312 can be permanently attached or integrally formed on the end of the discharge tube.

Support member 312 is formed from rigid tubing having a square cross-section and includes an upper attachment portion 318 and a lower bag gripping portion 320. Attachment portion 318 is formed by expanding the tubing to accept the end of round tube 310. A radially-enlarged flange 322 is located on the open end of gripping portion 320. Gripping portion 320 and flange 322 cooperate with bag retention device 314 to hold a coin bag on bag support member 312 as will be described in greater detail later.

Bag retaining device 314 includes a rigid "U" shaped body 324 and a knob 326. The body includes spaced-apart straight legs 328, 330. The legs are spaced apart a distance slightly greater than the width of support member lower portion 320, and have a length about equal to that width.

Figure 11:
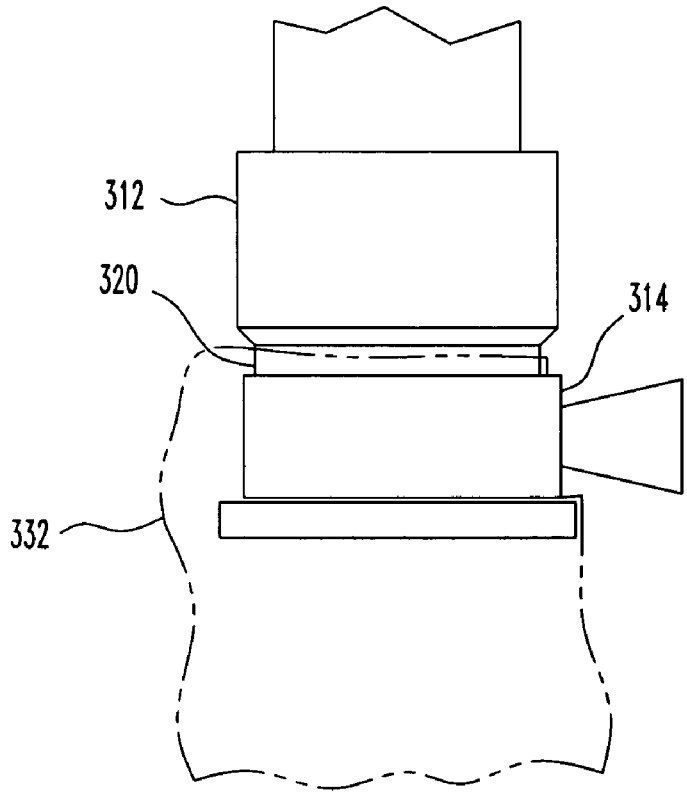
FIG. 11 is similar to FIG. 7 but with a coin bag being supported by the coin bag support.
Figure 12:
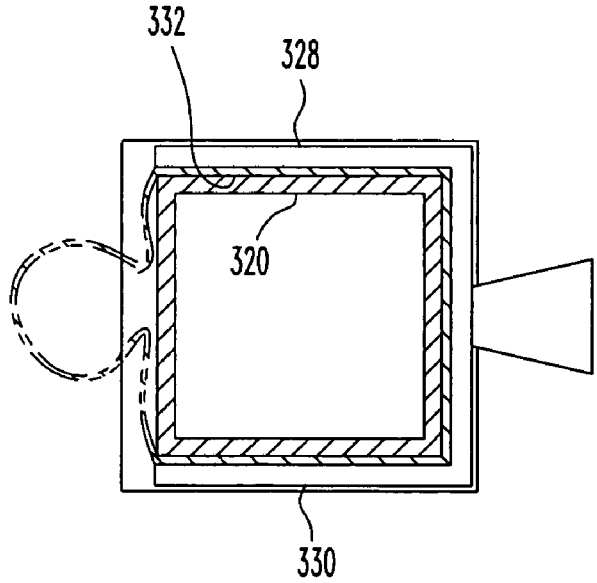
FIG. 12 is a view similar to FIG. 10 but with the coin bag being supported by the coin bag support.

FIGS. 11 and 12 illustrate a coin bag 332 supported on coin support member 312. The bag is conventional and can be made from cloth, plastic, or other suitable material. To support the coin bag 332 on the coin support member 312, the mouth of the bag is fitted over the end of the bag support member 312. The mouth is closed to fit snugly around the lower portion 320. The bag retention device 314 is slid onto lower portion 320 so that portion 320 is received within body 324 as shown in the figures. The legs 328, 330 are spaced sufficiently close to each other that the legs press the side of the bag against the sides of lower portion 320. The bag retaining device 316 is supported on flange 322 and squeezes the bag as shown against the support member and flange to hold the bag on the bag support member.

A filled bag is removed from the coin support member 312 by pulling the bag retaining device from the support member and freeing the bag.

FIGS. 13 and 14 illustrate a second embodiment coin bag support. Only differences between the first and second embodiment supports will be discussed. The outer surface of gripping portion 320 includes high friction material 334. The friction material 334 preferably has a number of asperities or teeth 336 that provide a high-friction surface. FIG. 14 illustrates leg 328 pressing bag 332 against the asperities or teeth 336.

A suitable material is Safety Walk™ Outdoor Tread tape distributed by 3M Construction and Home Improvement Markets Division, St. Paul, Minn. The tape has a rough surface with asperities or many small teeth for providing a slip-resistant surface on steps and other walkway surfaces. The tape forming the friction material 332 is two inches wide and approximately one-sixteenth inch thick. It is easily applied onto gripping portion 320 and easily replaced when worn.

FIGS. 15 and 16 illustrate steel dome nut 340 that retains steel disk 44 on the shaft of the drive motor. Nut 340 is threaded on the end of the shaft in a conventional manner.

The inertia of nut 340 urges the nut to rotate and move along the drive shaft away from disk 44 when the shaft stops quickly. A washer 342 is installed on the shaft between the nut 340 and disk 44 to resist loosening of the nut. Washer 342 is formed from anti-slip material that has a higher coefficient of friction against steel than would be generated between the nut and disk alone. A friction force is generated between the nut 340 and washer 342 and between the washer 342 and disk 44 that resists relative motion between the nut and disk when the shaft accelerates or decelerates during machine operation.

Washer 342 is preferably glued to the underside of nut 340 to be retained with the nut during disassembly of the machine. A suitable washer can be cut from a Brown Bear Anti-Skid Mat available from Circle, Inc., Burlington, Wash. The mat is made of rubber and is approximately one-sixteenth inch thick. The rubber is obtained from reclaimed crumb rubber from discarded automobile tires and a variety of die trimmings from rubber products. The material is believed to have a coefficient of friction against steel that can approach 1.0. Other commercially available anti-skid materials or other material compositions can be used.

While I have illustrated and described a preferred embodiment of my invention, it is understood that this is capable of modification, and I therefore do not wish to be limited to the precise details set forth, but desire to avail myself of such changes and alterations as fall within the purview of the following claims.

I claim:

1. A coin bag support for a coin receiving and processing machine to facilitate removal and replacement of coin bags from the machine, the coin bag support comprising:

a tube having an upper end for receiving coins and a lower end for discharging coins;

a bag support member on the lower end of the tube and a bag retaining device;

the bag support member comprising a bag gripping portion and an enlarged portion on the lower end of the tube, the bag gripping portion and the enlarged portion configured to fit into the mouth of a coin bag;

the bag retaining device comprising a U-shaped body configured to receive the bag gripping portion with a predefined clearance between a pair of legs of the U-shaped body, the clearance such that the bag gripping portion can be received in the body without touching the legs of the body when no bag is present and such that the legs press the bag against the bag gripping portion when the bag is present, the enlarged portion resisting downward motion of the bag retaining device when the bag gripping portion is received in the body.

2. The coin bag support of claim 1 wherein the bag gripping portion has a generally rectangular cross section.

3. The coin bag support of claim 2 wherein the enlarged portion comprises a flange having a generally rectangular cross section.

4. The coin bag support of claim 1 wherein the body of the bag retaining device is a rigid body.

5. The coin bag support of claim 1 wherein said clearance is approximately one-eighth inch.

6. The coin bag support of claim 1 wherein the coin bag support tube is attached to a coin discharge tube of a coin receiving and processing machine.

7. The coin bag support of claim 6 wherein the coin bag support tube has a radially enlarged end portion configured to receive the free end of the coin discharge tube.

8. A coin receiving and processing machine comprising at least one of the coin bag supports of claim 1.

9. A coin bag support of claim 1 wherein the bag gripping portion comprises asperities that grip a bag held by the coin bag support.

10. The coin bag support of claim 9 comprising tape on the bag gripping portion, the tape comprising the asperities.

* * * * *